US010081046B2

(12) United States Patent
Honegger et al.

(10) Patent No.: US 10,081,046 B2
(45) Date of Patent: Sep. 25, 2018

(54) PRECISION BLANKING PRESS

(71) Applicant: Feintool International Holding AG, Lyss (CH)

(72) Inventors: Hans-Ruedi Honegger, Wolfhausen (CH); Andreas Walther, Laupen (CH); Alex Wehrli, Kehrsatz (CH)

(73) Assignee: Feintool International Holding AG, Lyss (CH)

( * ) Notice: Subject to any disclaimer, the term of this patent is extended or adjusted under 35 U.S.C. 154(b) by 82 days.

(21) Appl. No.: 15/203,547

(22) Filed: Jul. 6, 2016

(65) Prior Publication Data

US 2017/0008062 A1 Jan. 12, 2017

(30) Foreign Application Priority Data

Jul. 6, 2015 (EP) ..... 15002021

(51) Int. Cl.

| | |
|---|---|
| ***B21D 28/00*** | (2006.01) |
| ***B30B 15/00*** | (2006.01) |
| ***B30B 1/32*** | (2006.01) |
| ***B21D 28/16*** | (2006.01) |
| ***B30B 1/34*** | (2006.01) |
| ***B30B 15/02*** | (2006.01) |

(52) U.S. Cl.

CPC ..... *B21D 28/16* (2013.01); *B30B 1/323* (2013.01); *B30B 1/34* (2013.01); *B30B 15/0035* (2013.01); *B30B 15/026* (2013.01); *B21D 28/002* (2013.01)

(58) Field of Classification Search

CPC .. B21D 28/002; B21D 28/16; B30B 15/0035; B30B 15/026; B30B 1/323; B30B 1/34

See application file for complete search history.

(56) References Cited

U.S. PATENT DOCUMENTS

| | | | | |
|---|---|---|---|---|
| 3,160,089 | A * | 12/1964 | Platou | B30B 15/284 100/214 |
| 3,424,080 | A * | 1/1969 | Pappas | F16B 31/043 100/214 |
| 8,141,482 | B2 * | 3/2012 | Schaltegger | B21D 28/002 100/219 |
| 2011/0000349 | A1 | 1/2011 | Schaltegger | |

FOREIGN PATENT DOCUMENTS

| | | | |
|---|---|---|---|
| DE | 47188 | C | 5/1889 |
| DE | 581753 | C | 8/1933 |
| DE | 1279622 | B | 10/1968 |
| DE | 2039644 | A1 | 3/1972 |
| DE | 2258655 | A1 | 6/1974 |
| DE | 19822436 | A1 | 10/1999 |
| DE | 2258495 | B1 | 11/2011 |

* cited by examiner

*Primary Examiner* — Stephen Choi

(74) *Attorney, Agent, or Firm* — Norris McLaughlin & Marcus, P.A.

(57) ABSTRACT

The invention relates to a precision blanking press including a top, a base and tie rods and columns that operatively connect the top and the base. The precision blanking press has a press frame with a high stiffness, low mass and simple design, the press allowing the transfer of higher cutting forces during fine blanking while safely eliminating axial play between adjustment elements and at the same time improving the operational safety.

14 Claims, 11 Drawing Sheets

PRECISION BLANKING PRESS

BACKGROUND OF THE INVENTION

The invention relates to a precision blanking press comprising a top, a base, and tie rods and columns that connect the top and base through non-positive connection, a knife-edged ring cylinder being disposed in the top, a knife-edged ring piston for moving knife-edged ring pins being guided in said cylinder, a main piston/ram disposed in the base, the piston/ram making a stroke movement and supporting a table top and having a counterstay cylinder chamber in which a counterstay piston is guided, a central adjusting mechanism disposed coaxial to the stroke axis and comprising an adjusting nut with internal threading and a knife-edged ring cylinder with external threading for adjusting the upper clearance relative to the main piston, and a hydraulic system for supplying the cylinder chambers disposed in the top and base with a fluid that is set to a predetermined pressure.

Press frames consisting of assembled components have existed for a long time.

DE 471 188 C2 discloses a press frame with stationary and rigidly connected beams, both ends of which are connected together by a cast iron frame connector piece.

DE 581 753 A discloses a press frame with assembled members and guiding tools, wherein the press table can move perpendicular to the press direction relative to the cross head, the cross head remaining fixed.

A dual-pedestal press for cutting or stamping out circuit boards from a belt of material is described in DE 22 58 655 C3, wherein the top, the pedestals and the table are connected together and secured by way of tie rods.

What all of these known press frames have in common is that the upper cross head or yoke is fixed and therefore the upper clearance cannot be adjusted, which makes these solutions unsuitable for precision blanking.

DE 1 279 622 A1 discloses a precision stamping press comprising a blanking piston, a pressing piston that presses the sheet material against the press table and a counterpressure piston that supports the part of the workpiece to be stamped out, wherein an adjusting spindle for adjusting a stop flange sits in the press head, the spindle limiting the upward stroke of the moving yoke. The lower stroke-limiting stopping of the moving yoke is adjusted by rotating threaded cylinders that fit one inside the other. The finely-threaded adjustment step is done using a hand wheel by way of a bottom worm gear on a gearwheel that is directly attached to the external threaded cylinder, whereas an electric motor is provided for rapid adjustments, the motor driving the screw by way of two bevel gears.

This known blanking head height-adjustment system does not provide sufficient adjustment and exactitude relative to the height position of the head due to the manual operation of the system. Another disadvantage is that repeatability of adjustment is low, with the quality of the precision cut parts suffering as a result.

Another disadvantage is that during blanking, spindle rotation, due to the naturally present axial play between the cylinders, cannot be completely eliminated.

Other known solutions use shaft key arrangements to adjust the distance between an upper die fastened to the ram of a press, the upper die cooperating with a lower die fastened to the press table (DE 2 039 644 A1), or hydraulically-actuated cylinders (DE 198 22 436 A1). However, these known solutions are unsuitable for precision blanking presses due to the interactions of the blanking piston, the knife-edged ring piston and the knife-edged ring pins.

According to EP 2 258 495 B1, a hydraulic precision blanking head for a mechanical press is known which is held on a top piece placed on a machine frame of the press above a ram that supports a table top and makes a stroke movement, the blanking head being in axial alignment with the stroke axis of the ram. A tubular part of a flange is used in the top piece, the collar of the tubular part being fastened non-rotationally by way of threaded connections on the side of the top piece facing the ram. The main cylinder is pushed concentrically into the tubular part, a knife-edged ring piston and a contact piston being disposed in the main cylinder, wherein the main cylinder is sealed shut pressure-tight by a cover or by a holding block. The main cylinder is connected to a hydraulic system that supplies the main cylinder with a fluid that is adjusted to a predetermined pressure.

The position of the hydraulic head relative to the ram is adjusted using an adjustment mechanism comprised of an adjusting nut that is provided with an inner adjustment threading and an outer adjustment threading disposed on the top of the main cylinder, the positioning being effected by way of a sprocket that is non-positively fastened at an end of the adjusting nut and disposed perpendicular relative to the stroke axis, a hydraulic motor and drive shaft held at the top, a drive chain looped around the drive shaft of the motor and the sprocket, and a brake that can be applied to the drive shaft, wherein the adjustment threading is connected to a channel for feeding the hydraulic system fluid, which has been regulated to an adjustable pressure, for the purposes of eliminating and releasing the axial play of the threads.

This known precision blanking head requires a series of open chambers to be pressurized with hydraulic medium and/or lubricant, which reduces the stiffness of the design and thereby the high force transmission needed for precision blanking. Also, this top piece is complicated due to the multitude of parts, and the adjusting nut is only secured by the sprocket at the top, such that adjustment forces are introduced essentially without any axial securing being done.

SUMMARY OF THE INVENTION

In light of this prior art, the object of the invention is to provide a precision blanking press characterized by a press frame with a high stiffness, low mass and simple design, the press allowing higher cutting forces during fine blanking while securely eliminating axial play between the adjustment elements and at the same time improving the operational safety.

The solution according to the invention is based on the realization that the stiffness of the press frame can be increased by reducing the number of components, and in particular by making the top and the base more compact and more solid.

This is achieved by designing the knife-edged ring cylinder as a one-piece core member in the top, a separate stripping/pushing cylinder with stripping/pushing piston in line with the stroke axis being disposed at the core member, and by associating an ejector piston with the counterstay piston in the main piston, wherein the stripping/pushing piston and the ejector piston each have associated working chambers that are independent of one another and are mutually connected hydraulically, and at least two diametrically opposite pre-loading pistons and piston rods disposed at the top are associated with the stripping/pushing cylinder/core member, each of said pre-loading pistons being guided in a pre-loading cylinder chamber in the top perpendicular to and in line with the adjusting nut, the cylinder being pressurized with fluid from the hydraulic system, wherein the piston rods are connected together by way of an adjusting cross member such that an adjustment motion of the pre-loading piston and the piston rods applies an external vertical adjusting force to the stripping/pushing cylinder/core member, locking or releasing the internal threading of the adjusting nut at the external threading of the core member axially, and the main piston comprises protruding discus-shaped working surfaces that subdivide working chambers disposed one atop the other vertically with minimal travel in the cylinder chamber of the base.

Another preferred embodiment of the precision blanking press according to the invention provides that the adjusting cross member comprises a base disposed perpendicular to the stroke axis, the base sitting on the stripping/pushing cylinder that is fastened to the core member so as to apply force to the core member.

This ensures that the axial play between the inner threading of the adjusting nut and the outer threading of the core member is either eliminated or is effected by the adjusting movement of the pre-loading pistons and piston rods.

In a preferred embodiment of the precision blanking press according to the invention, the stripping/pushing cylinder forms a cylinder chamber for receiving the stripping/pushing piston that is disposed on the stroke axis together with the knife-edged ring piston, said cylinder chamber being hydraulically separated from the knife-edged ring cylinder chamber, the piston rod of the stripping/pushing piston penetrating the center of the knife-edged ring piston that is guided in the cylinder chamber and being fastened to a pushing block associated with the knife-edged ring piston, wherein the pushing block is operatively connected to knife-edged ring pins that are guided in a perforated base and to pressure pins so as to separately transfer the knife-edged ring force and the stripping force. The subdivision into a stripping/pushing piston and a knife-edged ring piston makes it possible to separate the surfaces needed for stripping and displacing from one another and to adapt the surfaces according to the actually required forces.

It is beneficial that the knife-edged ring pins are disposed coaxial to the stroke axis and that they are supported at a knife-edged ring piston block for moving the knife-edged ring, wherein the knife-edged piston block comprises a support member with through holes in which the pressure pins for stripping are disposed and move vertically.

It is particularly important for the stiffness of the precision blanking press according to the invention that the top side of the core member facing the top comprises a tubular neck where the stripping/pushing cylinder is fastened non-positively and pressure-tight so that the core member can form a compact constructive unit with the stripping/pushing cylinder in the top, wherein the core member is held in place at the side thereof facing the bottom by way of a cover for covering the sprocket, the cover being attached to the bottom side of the top.

In another preferred embodiment of the precision blanking press according to the invention, the cylinder chamber of the stripping/pushing cylinder is sealed by a cover pressure-tight, a feed line for pressurizing a first working chamber of the stripping/pushing piston in the cylinder chamber of the stripping/pushing cylinder with fluid being passed through the cover and connected to the hydraulic system.

It is also advantageous that a channel is made in the wall of the stripping/pushing cylinder, the channel running parallel and perpendicular to the stroke axis, for pressurizing a second working chamber of the stripping/pushing piston in the cylinder chamber of the stripping/pushing cylinder with fluid of a predetermined pressure from the hydraulic system.

Also, another channel is made in the wall area of the stripping/pushing cylinder for pressurizing a working chamber for the knife-edged ring piston in the core member with fluid of a predetermined pressure from the hydraulic system. All of these features ensure that the compact unit of core member and stripping/pushing cylinder can be connected to the hydraulic system from the top.

According to another preferred embodiment of the invention, at least two channels for feeding fluid of a predetermined pressure from the hydraulic system to the knife-edged ring cylinder chamber, the channels running parallel in the direction of the stroke axis, are made in the wall area of the stripping/pushing cylinder. This ensures that the cylinder chamber of the stripping/pushing cylinder and the knife-edged ring cylinder chamber can each be pressurized with fluid of appropriately adjusted pressure separately from one another.

In another embodiment of the invention, the core member and the stripping/pushing cylinder are held in place secured against rotation by at least two diametrically opposite groove pieces at the top so that the radial positions of the core member and the stripping/pushing cylinder cannot change even when the adjusting nut is actuated.

In another useful embodiment of the invention, at least one channel is made in the top, the channel opening into the cylinder chamber of the pre-loading piston to supply the same with fluid and pressurizing the cylinder chamber so as to generate the adjusting force for locking or releasing the threads at the adjusting nut and the core member.

Another advantage is for the internal threading of the adjusting nut and the external threading of the core member to be saw-toothed threads, enabling high forces to be transferred in the axial direction when the play is eliminated.

It is also very important for the stiffness of the precision blanking press according to the invention that the base is compact and has a low design height. According to an advantageous embodiment of the invention, a cylinder chamber for a main piston is provided in the base, the discus-shaped working surfaces of the main piston subdividing the cylinder chamber into two working chambers, one atop the other with minimal travel, wherein a counterstay cylinder chamber for receiving a counterstay piston is designed in the main piston, the counterstay piston being penetrated by an ejector piston disposed axially in the stroke direction, the piston rod of said ejector piston being guided in a working chamber in line with the stroke axis.

The special discus-shaped design of the main piston in connection with the integration of the counterstay piston and the ejector piston into the main piston makes it possible to design the main piston compactly with a low stroke height, which gives the base a low design height and improves the stiffness off the press frame further.

According to another preferred embodiment of the invention, channels for feeding fluid of a predetermined pressure from the hydraulic system are made in the base so that each working chamber can be pressurized with hydraulic fluid separately according to the required pressures.

In another preferred embodiment of the press frame according to the invention, the top and the base are held together by four box-like columns through which tie rods are passed, wherein one end of the tie rod is screwed directly into the base and the other end is held at the top by a clamping nut under tension.

In an improvement of the press frame according to the invention, it is especially advantageous for the top and the base to be made of spheroidal cast iron and for the columns and the tie rods to be made of steel, wherein the base sits on the floor using levelers without the need for a foundation.

Other advantages and details can be found in the following description, with reference to the attached drawings.

The invention is described in more detail through the use of an exemplary embodiment for a press frame.

DETAILED DESCRIPTION OF THE INVENTION

Figure 1:
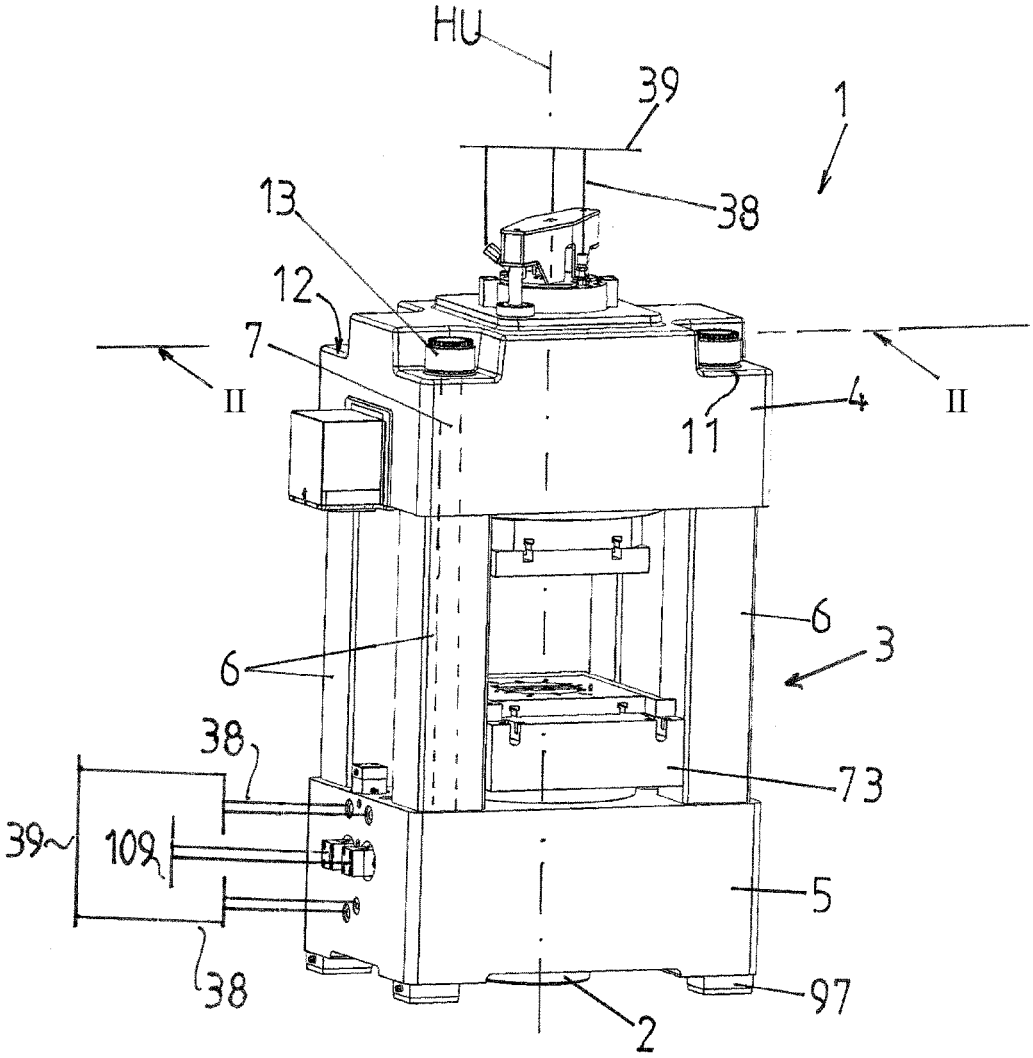
FIG. 1, a perspective view of a precision blanking press connected to the hydraulic system.
Figure 2:
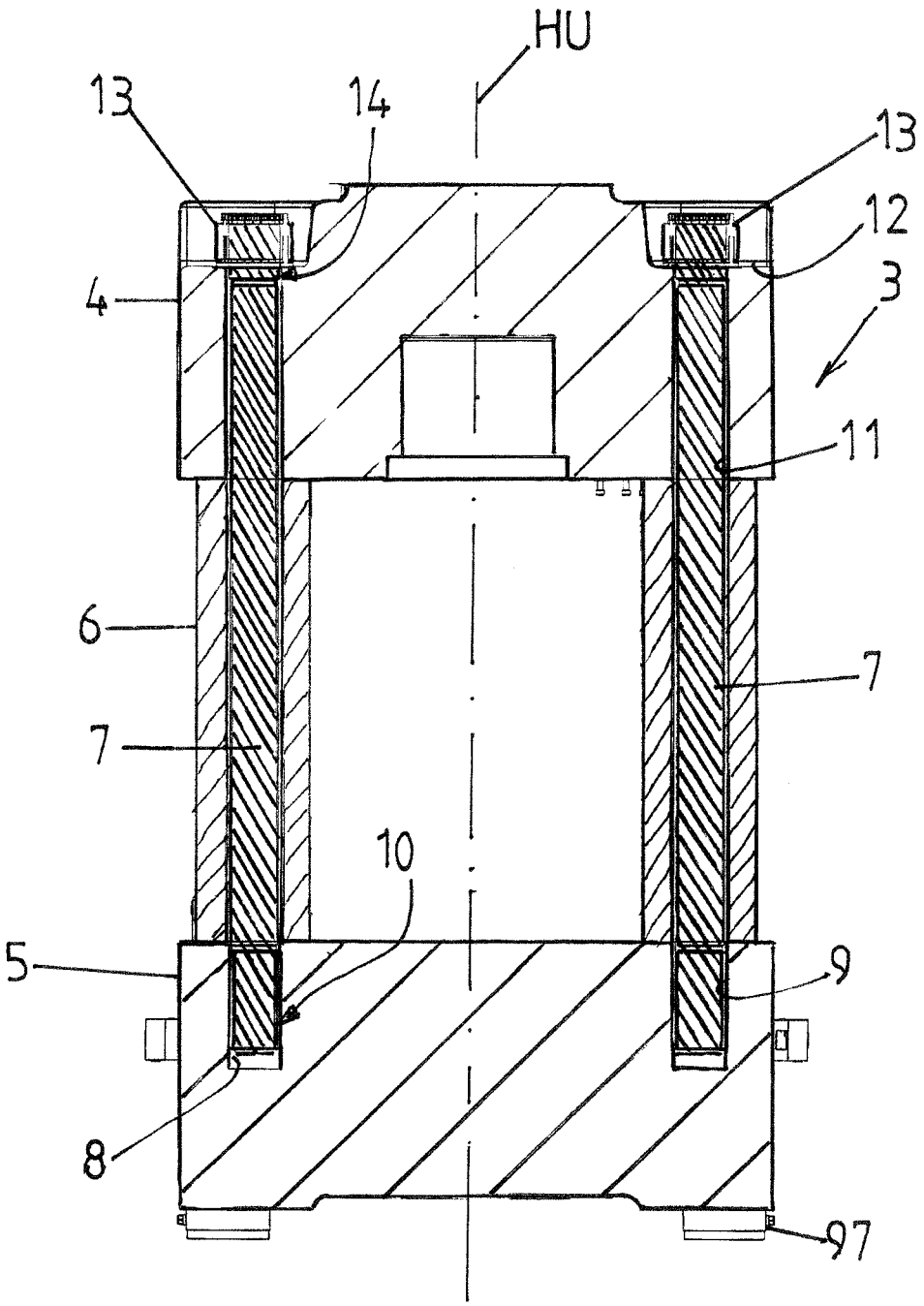
FIG. 2, a section of the press frame according to line II-II of FIG. 1.

FIG. 1 shows a perspective representation of a hydraulically-driven precision blanking press 1, the main drive 2 of which basically facilitating a stroke movement upward from below in the direction of the stroke axis HU. The press frame 3 of the press 1 comprises a top 4, a base 5, box-shaped hollow columns 6 and steel tie rods 7. Placed in each corner area of the rectangular base 5 is a blind hole 8 that runs parallel to the stroke axis HU, with internal threading 9 into which the externally threaded end 10 of the tie rod 7 facing the base 5 is screwed (see FIG. 2). The tie rod 7 penetrates the hollow columns 6 axially, passes through a hole 11 in the top 4, which sits on the hollow columns 6, each hole being located in a corner of the cubical top 4, the tie rod ending above a pocket-like seat 12 of the top 4 and being axially secured by a clamping nut 13 at the end 14 of the tie rod 7 facing the top 4 such that the top 4, the base 5 and the hollow columns 6 form an extremely stiff and solid press frame 3 of low mass.

Figure 3:
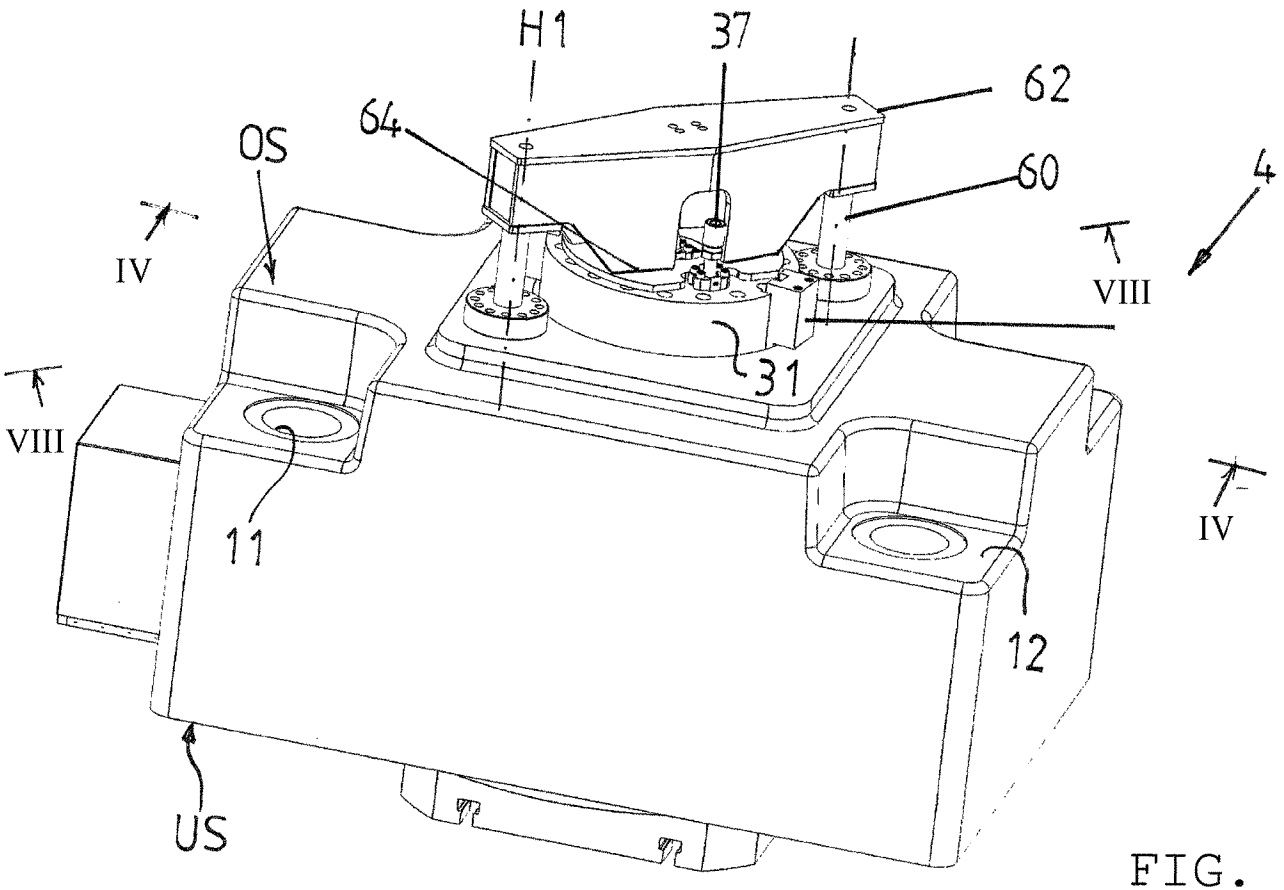
FIG. 3, a perspective view of the top with an adjusting cross member.
Figure 4:
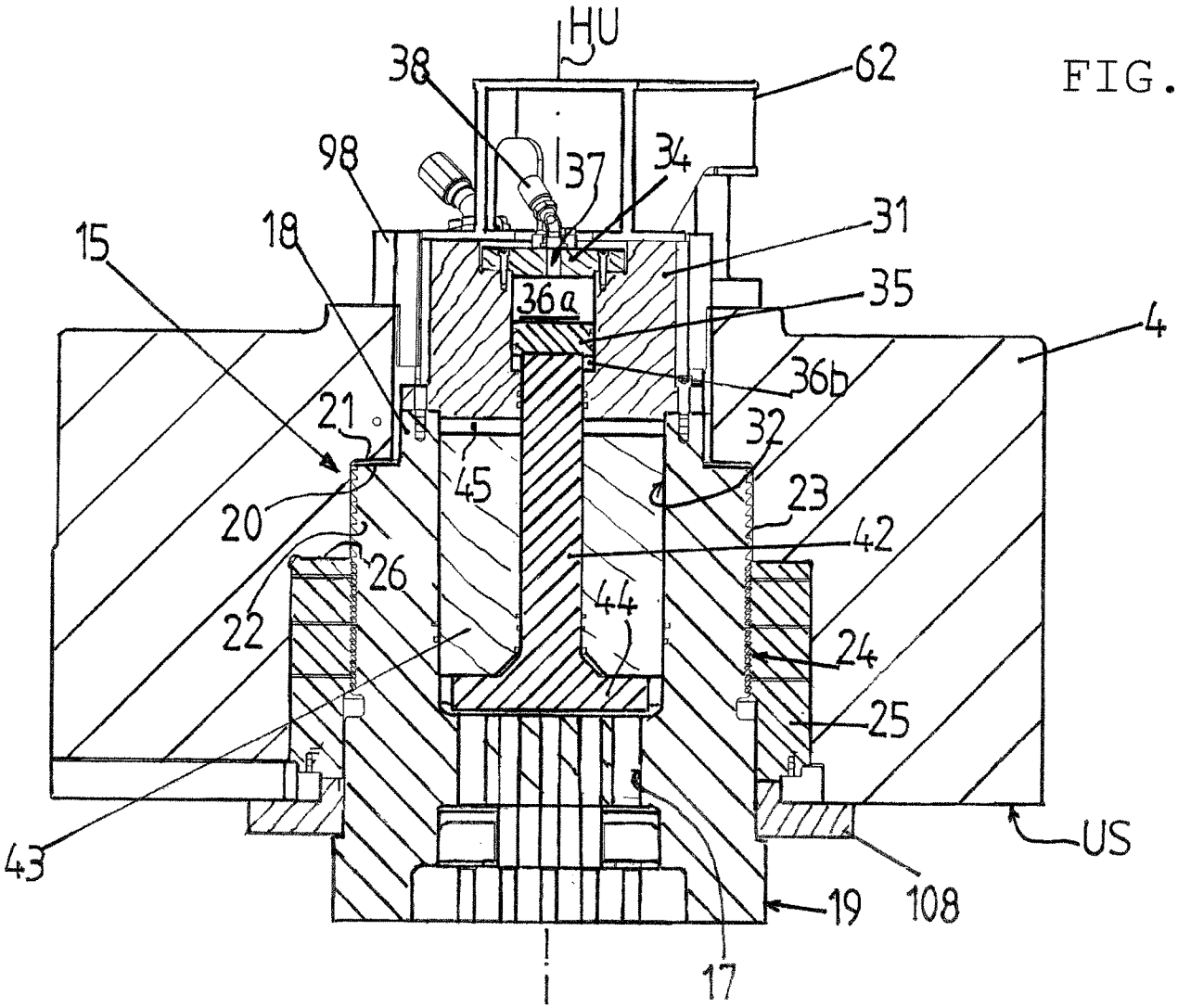
FIG. 4, a section of the top according to line IV-IV in FIG. 3.

FIGS. 3 and 4 show the top 4 in a perspective view and in a section according to line IV-IV of FIG. 3. A receiving space 15 for a one-piece core member 16 is located in the top 4 in line with the stroke axis HU, with a perforated base 17 facing the bottom side US of the top 4, a tubular neck 18 facing the top side OS of the top 4 and a flange 19 associated with the perforated base 17.

The core member 16 has an external sawtooth-shaped threading 23 on the outer surface 22 of the shoulder 20, the threading extending in the direction of the perforated base 17. The external threading 23 engages with the internal threading 24 of an adjusting nut 25 that is axially supported at a wall area 26 of the top 4, the wall being vertical relative to the stroke axis HU. This allows the core member 16 to change position relative to the main piston 2 when the adjusting nut 25 rotates, which makes it possible to adjust the upper clearance for different dies.

Figure 5:
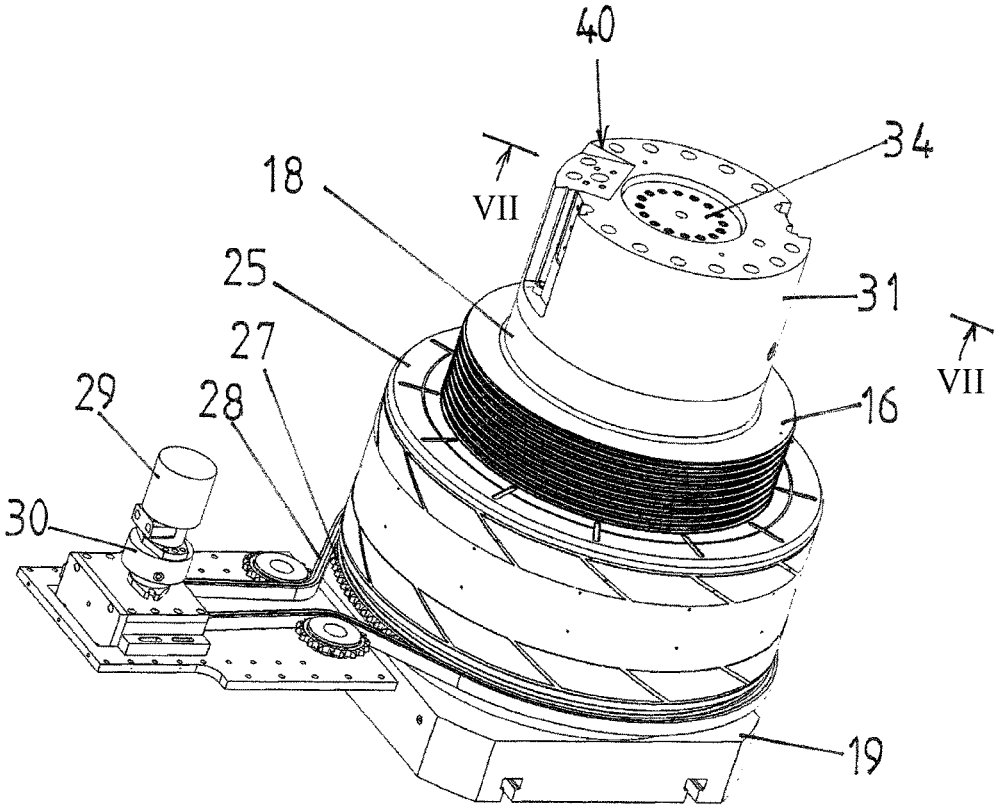
FIG. 5, a perspective view of the core member with the adjusting mechanism for the adjusting nut.

The actuator for the adjusting nut 25 corresponds to the prior art according to EP 2 258 495 B1 and therefore does not need to be further explained. The difference lies in the fact that the actuator, which is made up of a sprocket 27, hollow pin chain 28, hydraulic motor 29 and locking brake 30, is disposed at the bottom side US of the top 4 and held by a cover 108 that is fastened to the bottom side US of the top (see FIG. 5).

Figure 6:
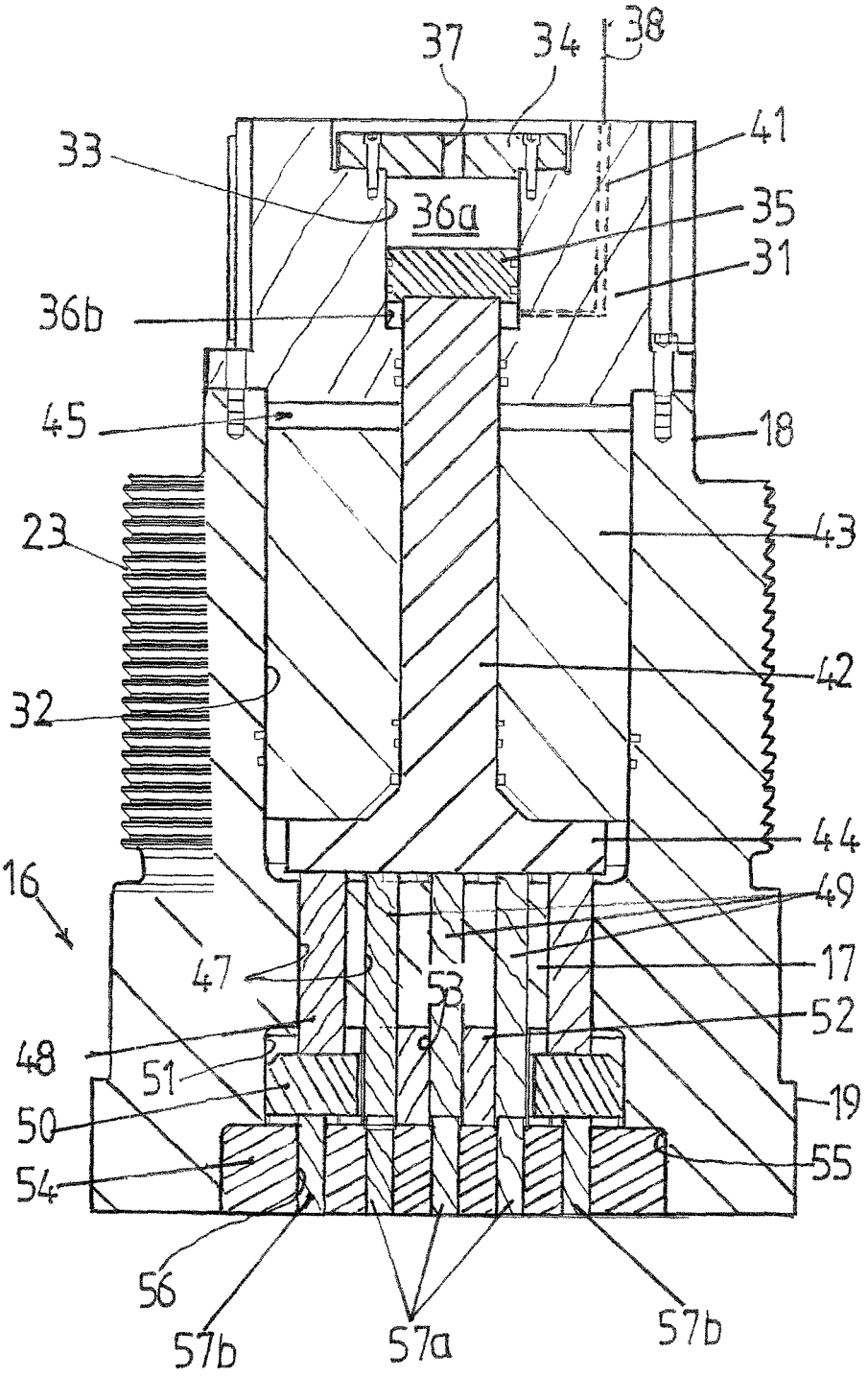
FIG. 6, a section through the core member with the stripping/pushing cylinder.

A stripping/pushing cylinder 31 is placed on the tubular neck 18 at the end of the core member 16 in abutment therewith, as shown in FIG. 6, coaxial to the stroke axis HU, the cylinder sealing the knife-edged ring cylinder chamber 32 pressure-tight by way of a bolted attachment. The core member 16 and the stripping/pushing cylinder 31 are secured at the top 4 against rotation using a groove piece 98. A cylinder chamber 33 is formed in the stripping/pushing cylinder 31, the chamber being sealed in by way of a pressure-tight, bolted cover 34 and containing a dual-acting stripping/pushing piston 35.

The stripping/pushing piston 35 subdivides the cylinder chamber 33 into a first working chamber 36*a* associated with one side of the stripping/pushing piston 35 and a second working chamber 36*b* associated with the other side of the stripping/pushing piston 35. The cover 34 has a center feed opening 37 for connecting a hydraulic line 38 of the hydraulic system 39 in order to pressurize the first working chamber 36*a* with hydraulic fluid. The second working chamber 36*b* is connected to the hydraulic system 39 for pressurization with hydraulic fluid of a predetermined pressure by way of a channel 41 made in the wall area 40 of the stripping/pushing cylinder 31 parallel and perpendicular to the stroke axis HU and to a hydraulic line 38.

The stripping/pushing piston 35 is connected to a piston rod 42 that is passed through a knife-edged ring piston 43 that is guided in the knife-edged ring cylinder chamber 32 along the stroke axis HU, the piston rod supporting a pusher block 44 that is supported on the perforated base 17 of the core member 16.

Figure 7:
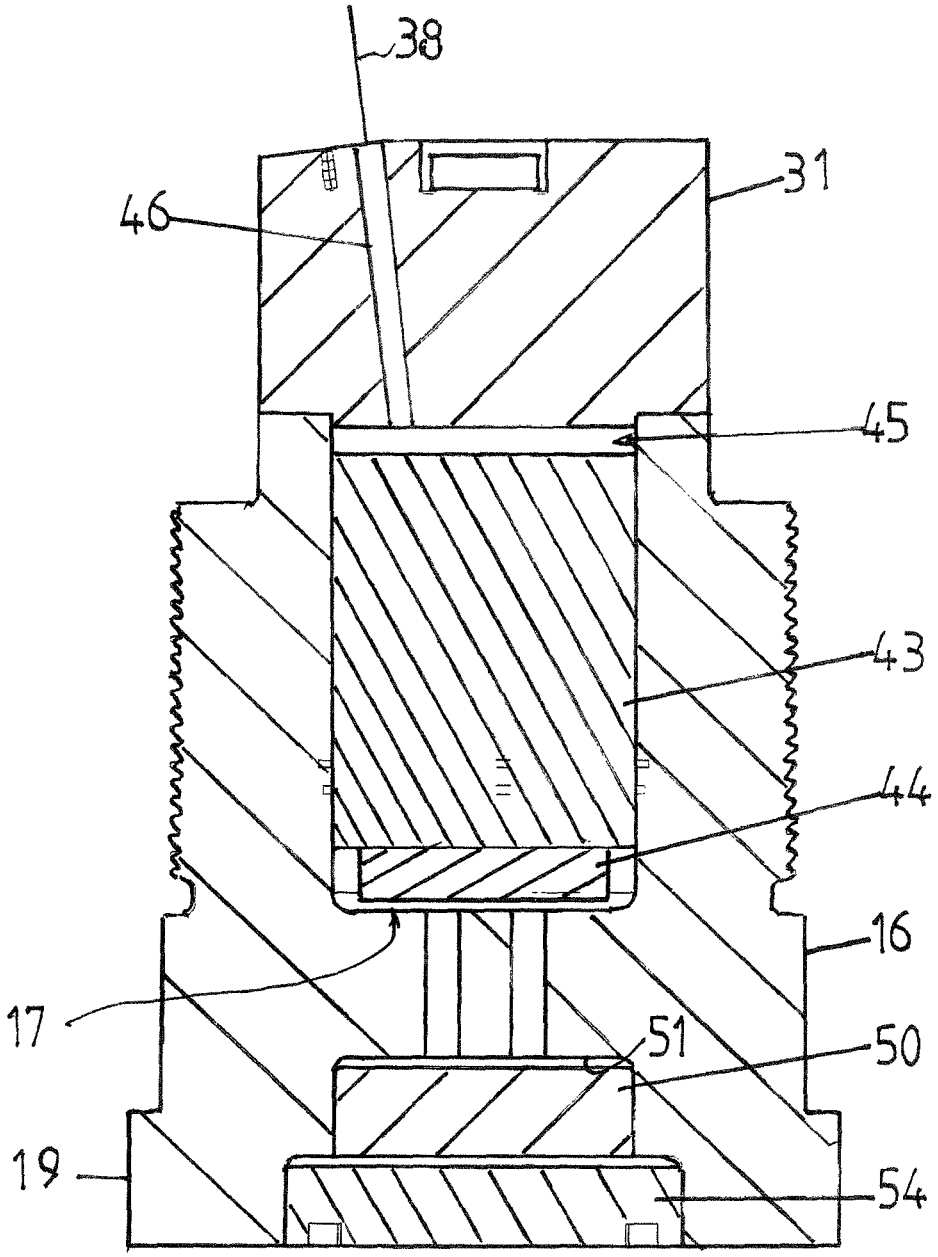
FIG. 7, a section of the core member with stripping/pushing cylinder according to line VII-VII in FIG. 5.

A working chamber 45 is associated with the knife-edged ring piston 43 in the knife-edged ring cylinder chamber 32, the working chamber being connected through hydraulic line 38 to the hydraulic system 39 by way of another channel 46 disposed in the wall area 40 of the stripping/pushing cylinder 31 (see FIG. 7).

Knife-edged ring pins 48 and pressure pins 49 are guided vertically displaceably in the holes 47 of the perforated base 17 in line with the stroke axis HU. Immediately below the perforated base 17 lies a coplanar piston block 50 inside a recess 51 of the core member 16, the piston block surrounding a centrally disposed, cylindrical washer-shaped support member 52. The support member 52 has through holes 53 for pressure pins 49, the holes being disposed coaxial to the stroke axis HU and the pins passing through the holes 53 of the support member 52.

A support block 54 is located below piston block 50 in a recess 55 that is opposite recess 51 and that is displaced outward in stepped fashion, wherein the support block 54 is disposed coplanar to piston block 50.

Through holes 56 are located in the support block 54, pressure pins 57*a* and 57*b* being guided in said holes, wherein pressure pins 57*a* are associated with pressure pins 49 that penetrate the support member 52 and pressure pins 57*b* are associated with the knife-edged ring pins 48.

In the blanking process, pressure pins 57*a* and 57*b*, a piston block 50, pressure pins 48 and 49, a pushing block 44, a piston rod 42, a stripping/pushing piston 35 and a knife-edged ring piston 43 move synchronously upward, in other words toward top 4. The hydraulic fluid in working chamber 45 of the knife-edged ring piston 43 and in the working chamber 36*a* of the stripping/pushing piston 35 is displaced.

As soon as the main piston/ram 2 reaches the upper dead point OT, the stripping/pushing piston 35 is activated and the stripping process begins, in other words the working chamber 36*a* is pressurized with hydraulic fluid. The stripping/pushing piston 35 synchronously pushes the pusher block 44 and thereby all the pressure pins 57*a*, 57*b*, 48, 49 as well as the piston block 50 downward, which is to say, toward the base 5. Said pressure pins push on the pressure pins in the die, which are not further shown, which strip away the blanking screen from the punch.

The knife-edged ring piston 43 follows behind the stripping/pushing piston 35 in parallel therewith or with a time delay, and at a lower speed, when the working chamber 45 is pressurized with hydraulic fluid.

Figure 8:
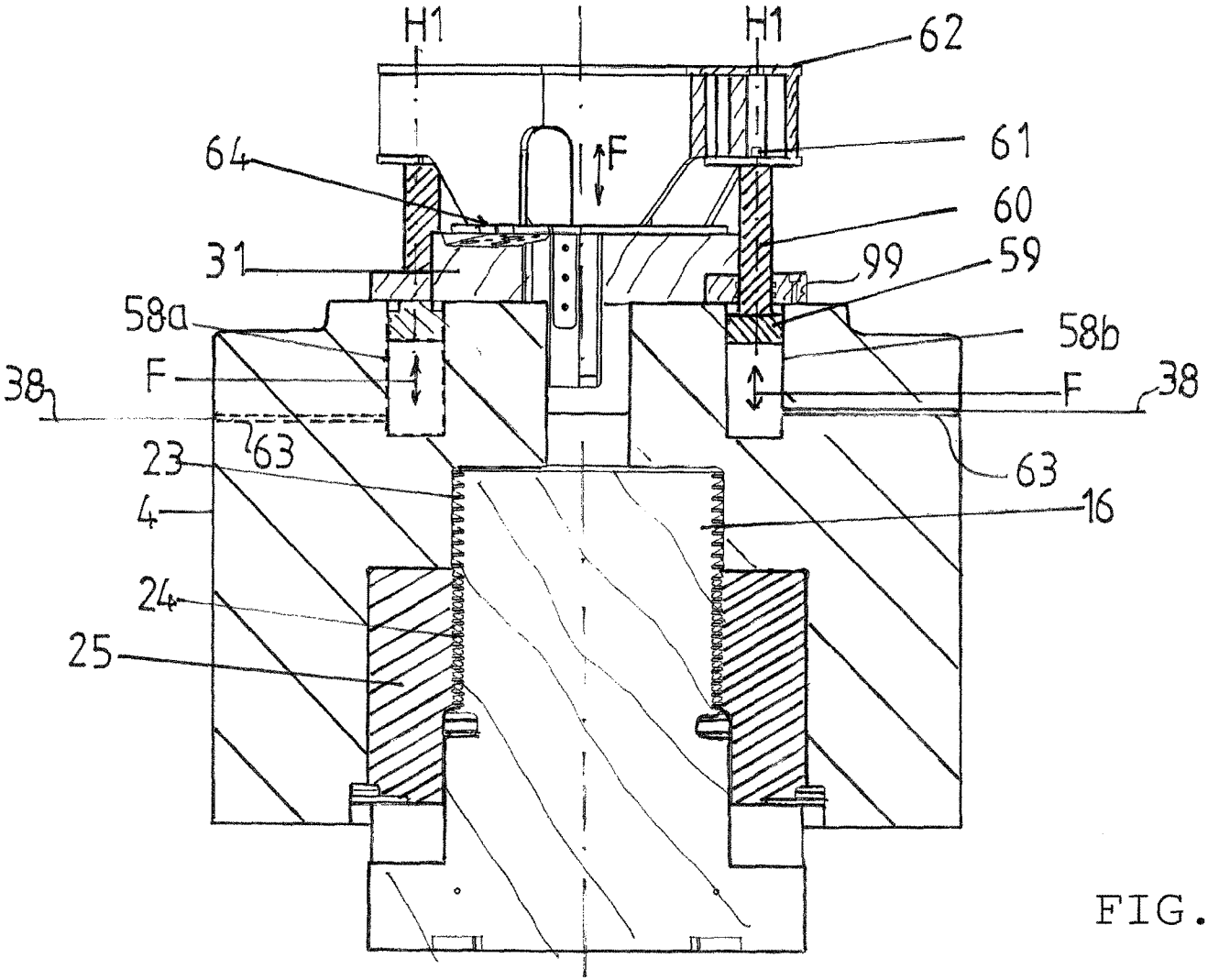
FIG. 8 a section of the top according to line VIII-VIII of FIG. 3.

As shown in FIG. 8, two pre-loading cylinder chambers 58*a* and 58*b* are located in the top side of the top 4, the two chambers being disposed diametrically opposite and near the external periphery of the stripping/pushing cylinder 31 and aligned parallel to the stroke axis HU and sealed pressure-tight by a cover 99.

One pre-loading piston 59 and piston rod 60 is guided in each of the pre-loading cylinder chambers 58*a* and 58*b*, respectively, along a stroke axis H1 that lies perpendicular to, and above, the adjusting nut 25. Each of the piston rods 60 of the two pre-loading pistons 59 is fastened to an adjusting cross member 62 using a screw 61, the adjusting cross member connecting the piston rods 60 together.

The pre-loading cylinder chambers 58*a* and 58*b* are each connected to the hydraulic system 39 by way of channels 63 made in the top 4, so that the pre-loading piston 59 is pressurized to a corresponding pressure of hydraulic fluid through a hydraulic line 38 and so that the piston can make a vertical movement, i.e. an adjustment movement.

As soon as the pre-loading piston 59 executes such an adjustment movement, the base 64 of the pre-loading cross member 62 transfers the adjusting force F to the stripping/pushing cylinder 31 from the top, and thereby to the core member 16. The core member 16 and the external threading 23 thereof thus execute this adjustment movement together and interlock with the internal threading 24 of adjusting nut 25. The sawtooth shape of the external threading 23 at the core member 16 and of the internal threading 24 of the adjusting nut 25 make it possible to absorb, in the interlocked state, such high forces as are common in precision blanking. When the pre-loading piston 59 is released, i.e. when the pressure of the hydraulic fluid is reduced, the interlocking of the external threading 23 and the internal threading 24 is released and the actuator can move the adjusting nut 25 to the desired position relative to the main piston 2.

Figure 9:
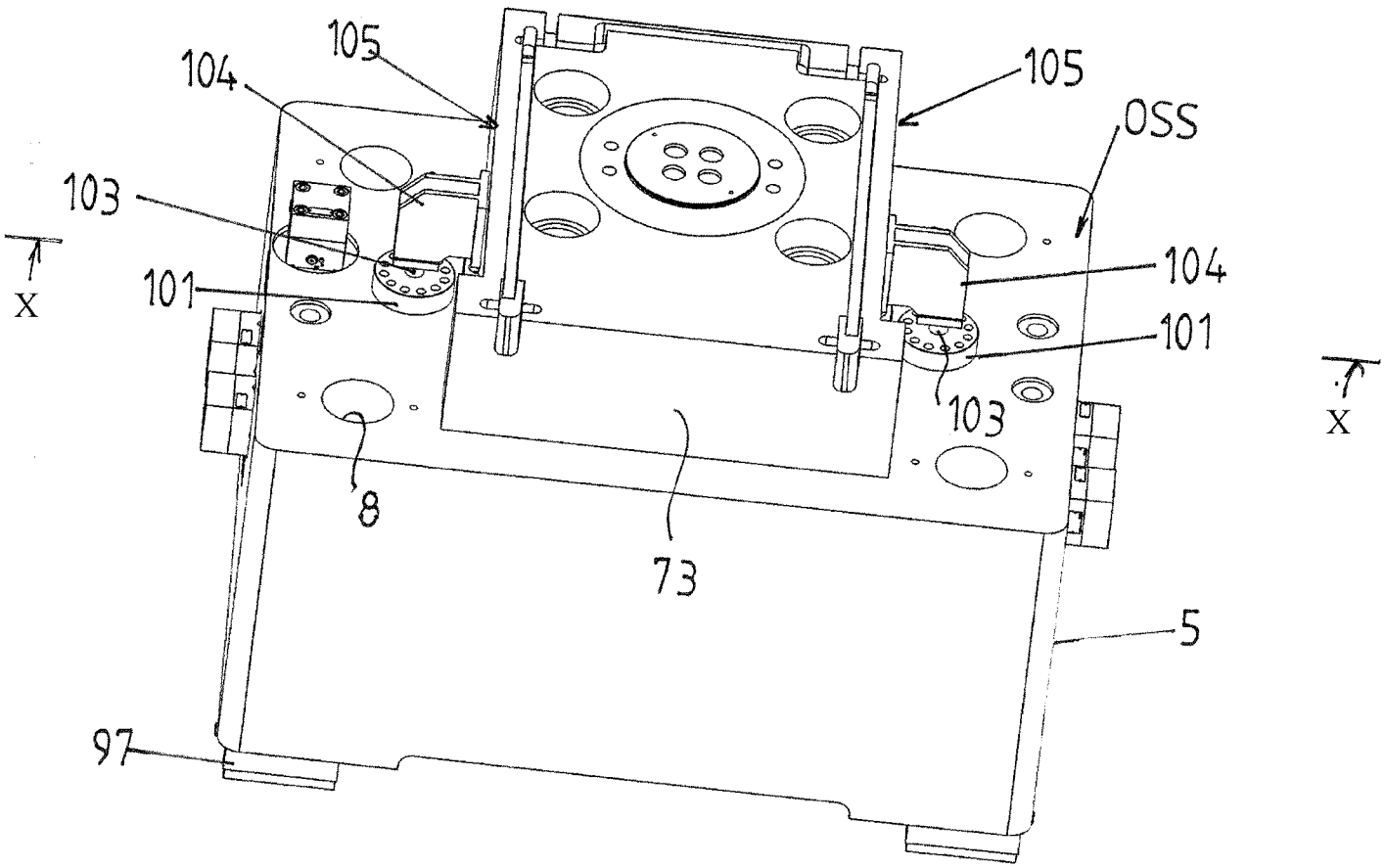
FIG. 9 a perspective view of the base with the table top.
Figure 10:
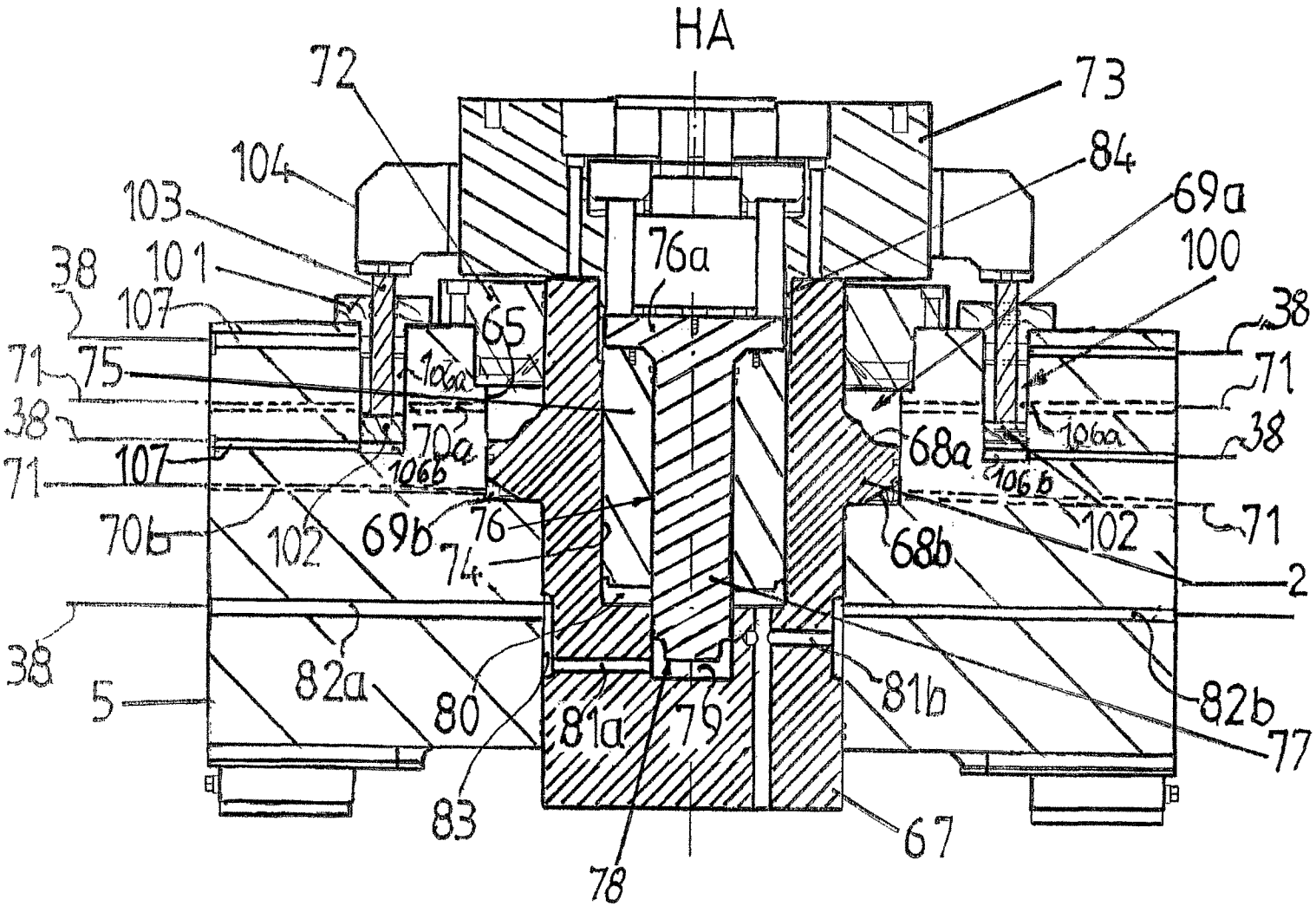
FIG. 10 a section of the base with the table top according to line X-X in FIG. 9.

FIGS. 9 and 10 show the base 5 in a perspective view and in a section according to line X-X.

As illustrated in FIG. 9, a table top 73 is disposed at the top side OSS of the base 5, the table top supporting the bottom part of the die, which is not shown. Two opposing cylinder chambers 100 are made in the base 5 aligned approximately centered relative to the blind holes 8 parallel to the stroke axis HU, each of the chambers receiving a dual-acting rapid traverse piston 102 and being sealed by a cover 101. The rapid traverse piston 102 has a piston rod 103 that is connected to a support 104 that is fastened to a side wall 105 of the table top 73. The rapid traverse piston 101 subdivides a first and a second working chamber 106*a* and 106*b* in the cylinder chamber 100. The working chamber 106*a* and the working chamber 106*b* are each connected to hydraulic line 38 of the hydraulic system 39 by way of a respective channel 107 made in the base 5 for pressurizing with hydraulic fluid of a predetermined pressure, so that it is possible to run the table top 73 in rapid traverse mode vertically in the direction of the top 4 (see FIG. 10).

A main cylinder chamber 65 is designed into the base 5, the axis HA of the chamber lying in the stroke axis HU of the precision blanking press 1 and receiving the dual-acting main piston 2. The main piston 2 has a cylindrical shaft 67 with discus-shaped working surfaces 68*a* and 68*b* that protrude from the axis HA of the shaft perpendicular thereto, the working surfaces subdividing the main cylinder chamber 65 into two working chambers 69*a* and 69*b* with minimal stroke height H so that base 5 has a low design height. Each of working chambers 69*a* and 69*b* is connected to the hydraulic system 39 by way of a channel 70*a* and 70*b*, respectively, through corresponding valves 109 (see FIG. 1) and connections and hydraulic lines 71 (see FIG. 10). The main cylinder chamber 65, and as a result working chamber 69*a*, are sealed off pressure-tight by way of a cover 72.

Figure 11:
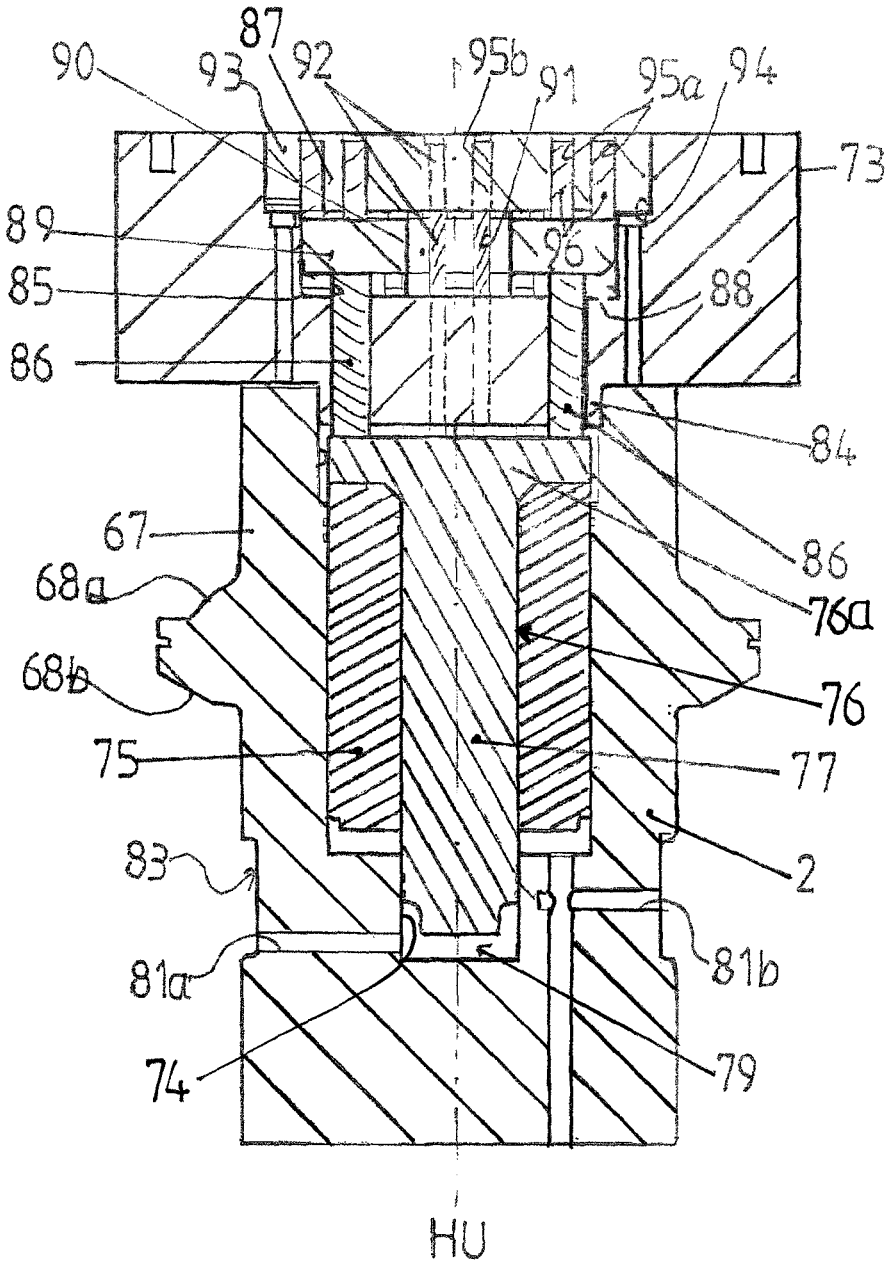
FIG. 11 a section of the main piston and the table top.

FIG. 11 shows another section through the base 5 and the main piston 2 with the attachment thereof to the table top 73.

A counterstay cylinder chamber 74 is formed in the main piston 2, a counterstay piston 75 and an ejector piston 76 being held in said chamber, the piston rod 77 of the ejector piston passing through the middle of the counterstay piston 75 and ending at the bottom piston rod end 78 in a working chamber 79 for piston rod 77. The counterstay piston 75 separates out a working chamber 80 in the cylinder chamber 74 of the main piston 2.

The working chamber 79 for the ejector piston 76 and the working chamber 80 for the counterstay piston 75 are connected to hydraulic line 38 of the hydraulic system 39 by way of separate channels 81*a* and 81*b* made in the shaft 67 perpendicular to the axis HA through distribution recesses 83 made in the shaft 67 and channels 82*a* and 82*b* in the base 5.

FIG. 11 refers to the arrangement and fastening of the table top 73. The bottom of table top 73 abuts the shaft 67 of the main piston 2 and has a protruding cylindrical bottom area 84 whose diameter is matched to the diameter of the shaft 67 of the main piston 2. The bottom area 84 of the table top 73 is provided with holes 85 disposed coaxial with stroke axis HU. Counterstay pins 86 are guided in holes 85, the pins being supported by a piston block 89 that is disposed in a recess 88 above the bottom area 84, the block surrounding a central cylindrical washer-shaped support member 90.

The support member 90 has through holes 91 coaxial to the stroke axis HU for pressure pins 92 that are led through the holes 91 of the support member 90. A support block 93 is located above piston block 89 in a recess 94 that is opposite recess 88 and that is displaced outward in stepped fashion, wherein the support block 93 is disposed coplanar to the piston block 89.

Through holes 95*a* and 95*b* are made in the support block 93, wherein pressure pins 96 are guided in the through holes 95*a*, the pins being associated with counterstay pins 86, and pressure pins 92 that pass through the support member 90 in through holes 95*b*.

The pressure pins 87 and 92, the piston block 89, the counterstay pins 86, the ejector block 76*a*, the piston rod 77, the ejector piston 76 and the counterstay piston 75 move synchronously upward during a blanking step. The hydraulic fluid in the working chamber 79 of the ejector piston 76 and in the working chamber 80 of the counterstay piston 75 is displaced.

As soon as the main piston 2 has reached the lower dead point UT, the ejector piston 76 is activated and the ejection of the blanked part punched into the die block begins, in other words working chamber 79 is pressurized with hydraulic fluid. The ejector block 76*a* presses all the pressure pins 86, 87 and 92 as well as the piston block 89 synchronously upward. Said pressure pins 87 and 92 press on the pressure pins in the die, which are not further shown, which eject the blanked part from the cutting opening of the die block and into the interior cavity of the die.

The counterstay piston 75 follows behind in parallel therewith or with a time delay, and at a lower speed, when the working chamber 80 is pressurized with hydraulic fluid.

By way of the constructive unit of the core member 16 and the stripping/pushing cylinder 31 in the top 4, and the integration of the ejector piston 76 into the counterstay piston 75 within the main piston 2, and due to the special shape of the main piston 2 in the base 5, the precision blanking press according to the invention constitutes an extremely stiff and compact design that makes it possible to support the press frame 3 using only the levelers 97 on the bottom without the need for a foundation.

The improved stiffness of the precision blanking press according to the invention also provides the advantage that a high-precision clearance adjustment can be ensured even with a low press mass at low operating costs.

The invention claimed is:

1. A precision blanking press comprising a top, a base, tie rods and columns operatively connecting the top and the base, a knife-edged ring cylinder disposed in the top, a knife-edged ring piston guided in the knife-edged ring cylinder configured for moving knife-edged ring pins, a main piston/ram disposed in the base, the piston/ram configured to make a stroke and supporting a table top and having a counterstay cylinder chamber in which a counterstay piston is guided, a central adjusting mechanism disposed coaxially to an axis of the stroke and comprising an adjusting nut with internal threading and the knife-edged ring cylinder with external threading for adjusting upper clearance relative to the main piston, and a hydraulic system configured to supply cylinder chambers disposed in the top and base with a fluid that is set to a predetermined pressure, wherein the knife-edged ring cylinder is a one-piece core member, a separate stripping/pushing cylinder with a stripping/pushing piston disposed on the stroke axis is disposed on the core member, and an ejector piston is associated with the counterstay piston in the main piston, wherein the stripping/pushing piston and the ejector piston each have associated working chambers that are independent of one another and are mutually connected hydraulically, and at least two diametrically opposite pre-loading pistons and piston rods are disposed at the top and are associated with the stripping/pushing cylinder and the core member, each of said pre-loading pistons is guided in a chamber of a respective pre-loading cylinder in the top parallel to an axis of the adjusting nut, the hydraulic system is configured to pressurize the pre-loading cylinder chambers, the piston rods are connected together by an adjusting cross member configured so that an adjustment motion of the pre-loading piston and the piston rods applies an external vertical adjusting force to the stripping/pushing cylinder and the core member, locking or releasing the internal threading of the adjusting nut at the external threading of the core member axially, and the main piston comprises discus-shaped working surfaces protruding radially outwardly and configured to subdivide a main cylinder chamber into working chambers disposed one atop the other vertically so as to minimize travel of the main piston/ram in the main cylinder chamber.

2. The precision blanking press according to claim 1, wherein the adjusting cross member comprises a cross member base disposed perpendicular to the stroke axis, and wherein the cross member base is disposed on the stripping/pushing cylinder that is fastened to the core member so as to apply the adjusting force to the core member.

3. The precision blanking press according to claim 1, wherein a top side core member facing the top comprises a tubular neck to which the stripping/pushing cylinder is fastened pressure-tight.

4. The apparatus according to claim 1, wherein the stripping/pushing cylinder comprises a cylinder chamber that is hydraulically separated from the knife-edged ring cylinder, the cylinder chamber of the stripping/pushing cylinder receives the stripping/pushing piston together with the knife-edged ring piston, a piston rod of the stripping/pushing piston passes through an axial center of the knife-edged ring piston and is fastened to a pushing block, and wherein the pushing block is operatively connected to the knife-edged ring pins that are guided in a perforated base and to pressure pins so as to separately transfer a knife-edged ring force and a stripping force.

5. The precision blanking press according to claim 4, wherein the knife-edged ring pins are disposed coaxial to the stroke axis and are supported at a knife-edged ring piston block for moving the knife-edged ring piston block, wherein the knife-edged piston block surrounds a support member with through holes in which the pressure pins are received and vertically movable.

6. The apparatus according to claim 1, wherein the stripping/pushing cylinder is sealed pressure-tight by a cover through which a feed line connected to the hydraulic system is guided, the feed line being configured to pressurize a first working chamber in a cylinder chamber of the stripping/pushing cylinder with fluid.

7. The apparatus according to claim 1, wherein the stripping/pushing cylinder is provided with a first channel in a wall area thereof and has a first section parallel to the stroke axis and a second section perpendicular to the stroke axis, the first channel being configured to pressurize a second working chamber in a cylinder chamber of the stripping/pushing cylinder with fluid of a predetermined pressure from the hydraulic system.

8. The apparatus according to claim 1, wherein the stripping/pushing cylinder is provided with a second channel configured to pressurize a working chamber for the knife-edged ring piston in the core member with fluid of a predetermined pressure from the hydraulic system.

9. The apparatus according to claim 1, wherein the stripping/pushing piston and core member are held in place rotationally-secured by at least two diametrically opposite groove pieces at the top.

10. The precision blanking press according to claim 1, wherein the top is provided with at least one channel that leads to the pre-loading cylinder chambers containing the pre-loading pistons and is configured to supply to the pre-loading cylinder chambers hydraulic fluid of a predetermined pressure.

11. The apparatus according to claim 1, wherein the internal threading of the adjustment nut and the external threading of the core member comprise saw-toothed threads.

12. The apparatus according to claim 1, wherein channels are provided in the base, each of the channels being configured to supply hydraulic fluid to respective of each of the working chambers associated with the main piston and the ejector piston.

13. The precision blanking press according to claim 1, wherein the top and base are made of spheroidal cast iron and the columns and the tie rods are made of steel, and the base is provided with levelers and is configured to rest on a floor without need for a foundation.

14. The precision blanking press according to claim 1, wherein a cylinder chamber for the counterstay piston is formed in the main piston, said chamber being axially traversed by the ejector piston that is displaceable axially in the stroke direction, a distal end of the piston rod of said ejector piston being guided in a separate working chamber.

* * * * *